US005703552A

United States Patent [19]

Buffet et al.

[11] Patent Number: 5,703,552

[45] Date of Patent: Dec. 30, 1997

[54] ELECTRICAL SAFETY SWITCH

[75] Inventors: Jean Claude Buffet, Sospel; Lionel Raut, Menton, both of France

[73] Assignee: Eaton Corporation, Cleveland, Ohio

[21] Appl. No.: 567,448

[22] Filed: Dec. 5, 1995

[30] Foreign Application Priority Data

Dec. 6, 1994 [FR] France ..... 94 14886

[51] Int. Cl.[6] ..... H01H 9/00

[52] U.S. Cl. ..... 335/205; 200/83 R; 218/57

[58] Field of Search ..... 335/205.7; 200/83 R; 218/83 Q, 22, 30, 57, 63, 65

[56] References Cited

U.S. PATENT DOCUMENTS 5,144,102 9/1992 Buse ..... 200/83 Q
5,308,939 5/1994 Sasaki ..... 200/83 R
5,425,396 6/1995 Wodeslavsky ..... 137/488
5,514,844 5/1996 Hamano et al. ..... 218/22

*Primary Examiner*—Lincoln Donovan
*Attorney, Agent, or Firm*—Roger A. Johnston

[57] ABSTRACT

For protecting the pump of a carpet cleaner, the cut-out terminals 16, 15 are commanded by the pressure of fluid in passage 11, 12, 13 which communicates with volume 22 having as an upper wall a flexible diaphragm 24. A fluid tight and electrically insulating housing 9 has a fixed boss portion 19 which is surrounded by a mobile annular permanent magnet 25 carried by diaphragm 24 and which guides a central mobile permanent magnet 20 which drives a mobile contact 18 up or down, closing or opening terminals 15, 16. High pressure at 11 drives diaphragm 24 and magnet 25 upwards, which attracts magnet 20 upwards, and connects terminals 15, 16 via mobile contact 18.

8 Claims, 2 Drawing Sheets

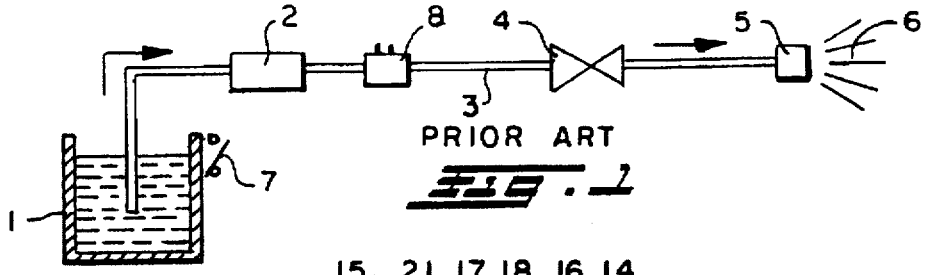
FIG. 1
FIG. 2
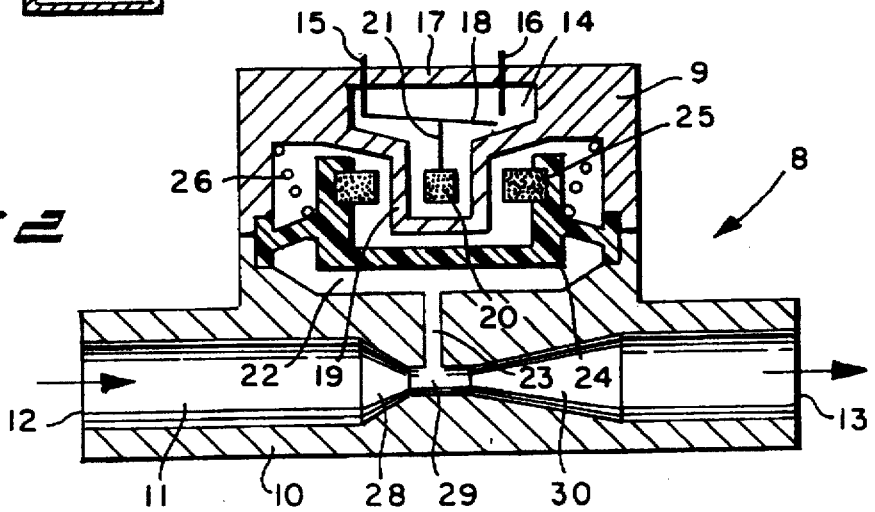
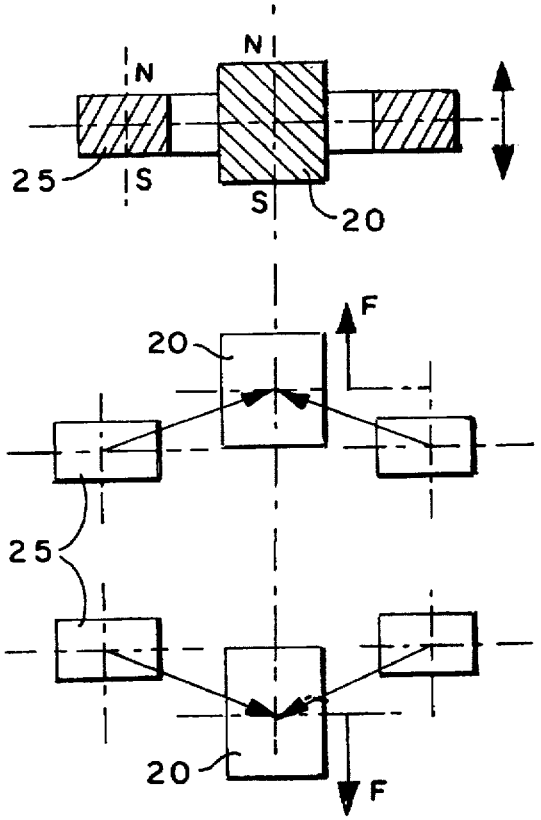
FIG. 3

ELECTRICAL SAFETY SWITCH

BACKGROUND OF THE INVENTION

This invention concerns an electrical safety switch actuated by the pressure of a liquid or gas. Said electrical switch has special application to the protection of pumps in rug, carpet, and floor washing machines, e.g., by preventing them from running dry or working when no water is available.

The operating principle of this known type of machine, commonly known as a "carpet shampooer", is summarized below, with reference to FIG. 1 of the appended illustrations. The apparatus features a reservoir 1, which contains a mixture of water and detergent. A pump 2, connected to reservoir 1, pressurizes the mixture of water and detergent and drives it through piping 3, which features manual valve 4. Said piping 3 ends at atomizer or spray nozzle 5. Under the pressure generated by pump 2, spray nozzle 5 applies the mixture of water and detergent, in the form of spray 6, to the rug or carpet to be cleaned.

The user can stop and start the flow of the water-detergent mixture toward spray nozzle 5 at will, by opening or closing manual valve 4. Pump 2 is actuated by manual electrical switch 7 located on the machine. A pressure-sensitive safety switch 8 may be installed on piping 3, at the exit of pump 2. Said safety switch automatically shuts off pump 2 if power is delivered to said pump via electrical switch 7 while manual valve 4 is still closed.

The operating principle described above and shown in FIG. 1 has a major drawback, inasmuch as pump 2 can be run without interruption for as long as manual electrical switch 7 remains in the closed position. For example, pump 2 can run dry when reservoir 1 is empty, or at maximum pressure when there is no water flow, because the user has forgotten to open manual valve 4. In both cases pump 2 is no longer cooled by the flow of water (which also lubricates its moving parts), and is rapidly destroyed.

Many manufacturers of such devices have already added to their design a simple pressure-sensitive switch 8, which uses a diaphragm actuated by the abnormally high pressure present at the exit of pump 2 when manual valve 4 is closed. Pressure-sensitive switch 8 then cuts off power to pump 2. However, such pressure-sensitive switches do not work in a fully satisfactory manner.

Their first drawback is that their electrical insulation is not of the so-called "reinforced" type called for by European standard IEC 335 for Class II electrical devices.

Furthermore, existing pressure-sensitive switches cannot differentiate between water pressure and air pressure. Therefore, they cannot protect the pump of the carpet shampooer by shutting it off both when the manual valve is closed and when the reservoir is empty.

Finally, existing pressure-sensitive switches are relatively complicated and costly to manufacture, notably because they must incorporate a quick-switching contact-pressure spring.

SUMMARY OF THE INVENTION

This invention aims to eliminate all the foregoing drawbacks by creating an electrical safety switch which can replace the existing pressure-sensitive switches described above. The present inventive electrical safety switch offers reinforced electrical insulation, is simpler to make, and can, when used in a carpet shampooer or similar device, differentiate between the lack of liquid and the lack of circulation in the machine, even when the pressure of the liquid under normal operating conditions is equal to the pressure of the air compressed by the pump when the reservoir is empty.

To this end, the device according to the invention is an electrical safety switch actuated by the pressure of a liquid or gas, featuring a body with a passage for said liquid or gas; a chamber which communicates with said passage; a moving and/or flexible part placed inside the chamber and linked to an annular magnet; an electrically insulated sealing wall surrounded by said annular magnet, which houses and guides a central, axially displaced magnet mechanically linked to a moving contact device, such as a contact tongue. Said contact tongue cooperates with at least one fixed electrical terminal to either close or open an electrical circuit, depending on the position of the central magnet which is magnetically coupled with the coaxial annular magnet. The position of the annular magnet is itself a function of the pressure of the fluid entering the chamber mentioned above.

The device according to the invention uses two permanent, coaxial magnets, magnetically linked and positioned on either side of an insulating wall which separates the part of the switch which is in contact with the fluid (e.g., water) from the part which contains its electrical contacts. The desired "reinforced" electrical insulation can be obtained by selecting a sufficiently thick insulating separation wall. Furthermore, the use of permanent, magnetically linked magnets allows rapid switching between the open and closed positions and provides an appropriate contact pressure in the closed position, without any need for springs. This in turn greatly simplifies the manufacturing process.

In a preferred embodiment of the invention, an annular spring surrounds a flexible diaphragm immobilized along its edges. Said diaphragm defines a space of variable size into which the pressurized fluid is admitted. This fluid then exerts pressure on one side of the flexible diaphragm, which is also subjected, on the other side, to the pressure of a return spring which pushes it back toward its resting position (i.e., the position it occupies at minimum fluid pressure). For instance, the edges of the flexible diaphragm might be immobilized between the aforementioned body and an insulating housing featuring a cylindrical inner wall which is surrounded by the annular magnet and which houses and guides the central magnet; this insulating housing bears the electrical terminals which work with the contacts of a tongue type of device actuated by the central magnet.

It is advantageous to arrange the central and annular magnets so that their corresponding end faces (i.e., the ends which face in the same direction) are of identical polarity. This way, when the annular magnet is displaced in one direction by the fluid pressure, the central magnet (and, therefore, the moving contact device, e.g., contact tongue) moves in the opposite direction under the effect of magnetic repulsion. The use of magnetic repulsion between the poles of the two coaxial magnets allows for rapid, springless switching back-and-forth between the closed and open position. Magnetic repulsion also applies contact pressure to the electrical contacts when the switch is in the closed position.

Another characteristic of the invention is the fact that the fluid passage inside the switch body features a venturi between the inlet and the outlet. The neck or throat of said venturi has a top which opens into the chamber which houses the moving and/or flexible part linked to the annular magnet. A switch equipped with this latter feature is particularly useful for application to a machine of the carpet shampooer type, as a safety switch for the pump which pressurizes the water-detergent mix from a reservoir. The safety switch according to the invention is thus a marked improvement over traditional pressure-sensitive switches.

The problem with the known carpet shampooers is that they usually work with the dynamic pressure of the water-detergent mix roughly equal to that of the pressurized air space created when the reservoir is empty and the manual valve closed. This makes it impossible to use an ordinary pressure-sensitive switch (which would be calibrated at a pressure roughly equal to that of the liquid under normal operating conditions), because it would cut power to the pump during normal operation. Since it features a venturi, the safety switch according to the invention solves that problem by reacting differently to two equal fluid pressures, depending on whether the fluid in question is a liquid or a gas (e.g., water or air). This is because the pressure loss created by the venturi is greater in the case of water than in the case of air. Thus, the safety switch according to the invention can be calibrated to break the electrical connection at a set pressure which can be produced in the hydraulic circuit by either water or air; but it will only be triggered when it is air which rises above said set pressure, i.e., when there is no water in the circuit (empty reservoir). Of course, the switch also cuts power to the pump when the circuit is filled with nonflowing, high-pressure water (i.e., when the manual valve is closed), because in that case, the venturi isn't operative.

BRIEF DESCRIPTION OF THE DRAWINGS

FIG. 1 is a schematic of a carpet shampooer known in the art;

FIG. 2 is a detailed cross section of an electrical safety switch according to the invention, with application to the protection of a carpet shampooer pump;

FIG. 3 is an operational diagram showing in three views the magnetic operation of the electrical safety switch of FIG. 2;

DETAILED DESCRIPTION

Figure 4:
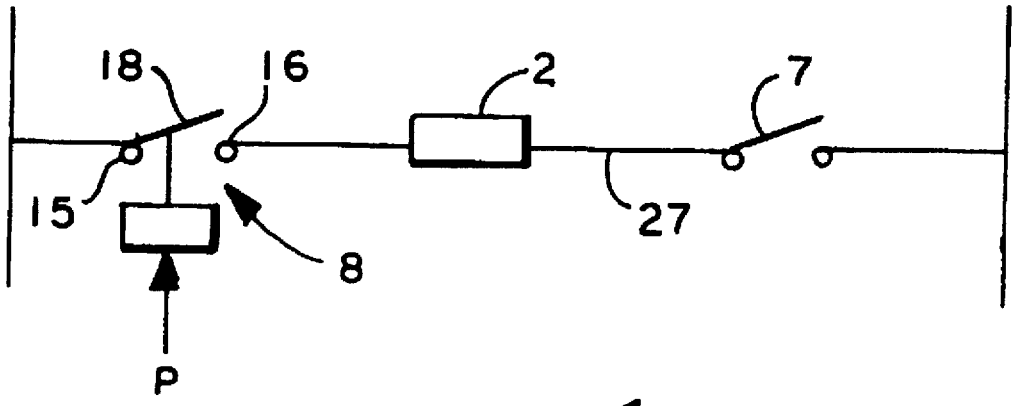
FIG. 4 is an operational diagram showing the electrical operation of the switch, as used in a carpet/shampooer.

The electrical safety switch illustrated in FIG. 2, which corresponds to reference 8 in FIG. 1, features an electrically insulating casing 9, mounted on a body 10 with an inside fluid passage 11 extending from fluid inlet 12 to fluid outlet 13.

Insulating casing 9 defines cavity 14, which is completely closed on all sides. Two electrical connection terminals 15 and 16 run through upper or outer wall 17 of insulating casing 9 and protrude into cavity 14. A moving contact tongue or blade 18, housed inside cavity 14, interacts with the two terminals 15 and 16 to either close or open the electrical connection between the terminals 15 and 16.

Cavity 14 is bounded by inner cylindrical wall 19 of insulating casing 9, which houses and guides a central, axially displaced cylindrical magnet 20. Contact tongue 18 is mechanically linked to central magnet 20 by linking rod 21, which transmits the axial motion of central magnet 20.

A chamber 22 of generally cylindrical shape connects insulating casing 9 to body 10. Chamber 22 communicates with the fluid passage 11 of body 10 at the throat 29 via tap or duct 23.

The edges or periphery of a flexible diaphragm 24, inside chamber 22, are immobilized and sealed between insulating casing 9 and body 10 in the mating plane of the latter parts. The central, moving part of flexible diaphragm 24 supports annular magnet 25, which surrounds the inner cylindrical wall 19 of insulating casing 9 and is coaxial with central cylindrical magnet 20.

Flexible diaphragm 24 is equipped with a helical spring 26, also housed inside chamber 22. This spring has its lower end registered against diaphragm 24 and pushes diaphragm 24 back toward its resting position, i.e., downwardly toward body 10.

The magnetic principle which governs the operation of the switch is illustrated in FIG. 3.

Internal cylindrical magnet 20 and external annular magnet 25 are coaxial and of axial polarization. In addition, they both have the same poles facing in the same direction. For instance, pole N of central cylindrical magnet 20 may be on its upper circular face, with pole N of external annular magnet 25 on its upper annular face; in this case pole S of central cylindrical magnet 20 is on its lower circular face, while pole S of external annular magnet 25 is on its lower annular face. Thus, the set of magnets 20 and 25 works by magnetic repulsion, as identical adjacent poles (N or S) repel each other.

At rest, flexible diaphragm 24 is pushed back in its lowered position by helical spring 26. As illustrated in the middle view of FIG. 3, annular magnet 25 is then in its lowered position and magnetically thrusts central cylindrical magnet 20 upward, which closes electrical switch 8, as contact tongue 18 is pushed by central magnet 20 against both terminals 15 and 16. In this closed position, the upward thrust F of central magnet 20 provides the contact pressure of tongue 18 against terminals 15 and 16.

When the air pressure or water pressure P inside fluid passage 11 rises above a set abnormal value, said pressure is transmitted to chamber 22 and distends flexible diaphragm 24 upward, against its return spring 26. Thus, diaphragm 24 pushes external annular magnet 25 upward. As illustrated in the lower pan or view of FIG. 3, the upward motion of external annular magnet 25 magnetically causes central magnet 20, linking rod 21 and, therefore, contact tongue 18 to move quickly downward, which opens electrical switch 8. The opening of contact tongue 18 is effected solely by the magnetic repulsion force of magnets 20 and 25.

In the case of the specific application considered here, the opening of electrical switch 8 cuts power to, and thus stops, the pump 2 which it is designed to protect. Said pump is electrically wired in series with electrical safety switch 8 and with manual electrical switch 7, in an arm of electrical circuit 27 (see FIG. 4).

When pressure drops inside the machine's hydraulic circuit, e.g., at inlet 12, spring 26 pushes diaphragm 24 (and, therefore, magnets 20 and 25) back to their initial (rest) position. Switch 8 then closes, so that the carpet shampooer can resume normal operation.

With reference to FIG. 2, in a preferred embodiment of the invention, fluid passage 11 of body 10 takes the shape of a venturi between fluid inlet 12 and fluid outlet 13, with a collector 28, a neck or throat 29 and a diffuser 30, with duct 23 starting at neck 29 of the venturi. The pressure loss created by venturi 28, 29, 30 in chamber 22, at the level of diaphragm 24, is greater when there is water inside fluid passage 11 than when there is air in it. This creates a difference between the effect of air pressure and water pressure inside piping 3 of the machine.

Thus, in the case of a carpet shampooer with a water-detergent mix at a dynamic pressure roughly equal to the pressure of the compressed air space created by the pump when the reservoir is empty and the manual valve 4 closed, electrical switch 8 stops pump 2 only when there is nothing but air inside fluid passage 11, i.e., when pump 2 must be shut down for lack of water. In fact, thanks to venturi 28, 29, 30, electrical switch 8 never "sees" the real water pressure during normal operation, since a pressure differential ΔP is generated between the outlet of pump 2 and the pressure transmitted to duct 23. This pressure differential ΔP lowers the pressure inside chamber 22 to a value which is below the calibration pressure of electrical switch 8.

Conversely, when the user forgets to open manual valve 4, water pressure rises statically, without flow, so that venturi 28, 29, 30 doesn't work. Therefore, electrical safety switch 8 can now detect the actual water pressure and shuts down pump 2, as it should in such a case.

Thus, pump 2 will be shut down, and therefore protected, in the following situations:

no water in reservoir 1;

no water flow inside piping 3, due to the closure of manual valve 4.

Figure 5:
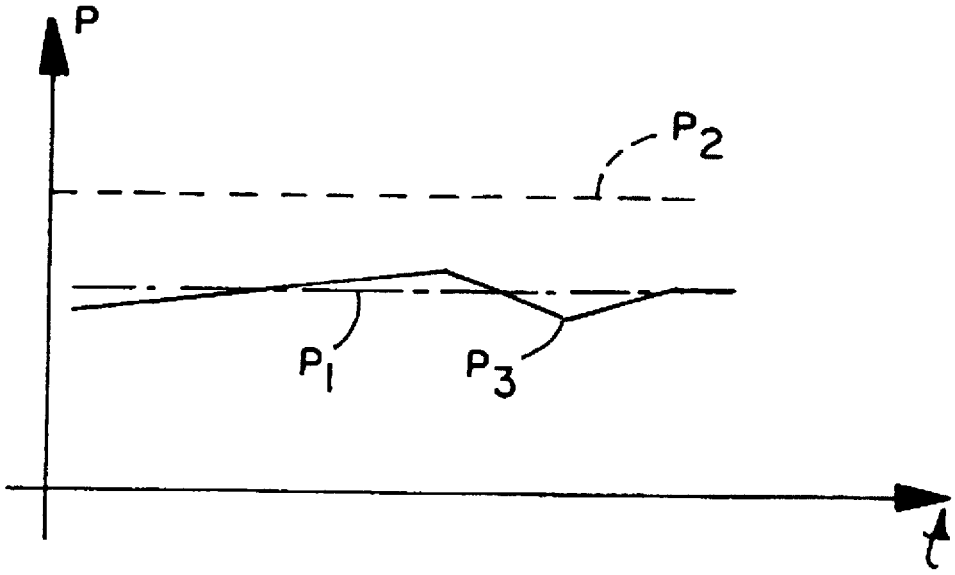
FIG. 5 is an operational diagram showing the operation of a carpet shampooer under pressure.

FIG. 5 gives a better idea of the way the carpet shampooer works under pressure. It shows, over time t, water pressure P1 during normal use, water pressure P2 when manual valve 4 is closed, and air pressure P3 when reservoir 1 is empty. Air pressure P3 is roughly equal to water pressure P1 during normal use, which is lower than the maximum water pressure P2 usually generated when manual valve 4 is closed. Water pressure P2 is eliminated by the electrical safety switch 8 according to the invention, since said switch immediately shuts down pump 2 when the pressure rises to the P2 level.

Furthermore, it should be noted that certification of switch 8 for "reinforced" insulation is guaranteed by the fact that the walls of insulating casing 9, and especially of inner wall 19 which faces diaphragm 24 and the water inside chamber 22, are made of an electrically insulating material of a minimum thickness of 2 mm at all points.

The scope of the invention is not limited to the embodiment described above by way of example, but extends to all variants of manufacture and of use based on the same principle. Thus, the details of the shapes of the various parts of the fluid-pressure actuated electrical switch, its use on machines, installations or circuits of all types, as well as the nature of said fluid (whether liquid or gas) can vary from application to application without leaving the scope of the invention.

We claim:

1. Electrical switch, actuated by the pressure of a liquid or gaseous fluid, characterized in that it features a body with a fluid passage; a chamber communicating (at point) with said fluid passage; a moving and/or flexible part inside the chamber, linked to an annular magnet; an electrically insulated, sealed inner wall surrounded by annular magnet, which houses and guides an axially displaced central magnet, mechanically linked at point to a mobile contact piece, such as a contact tongue, which cooperates with at least one fixed electrical terminal to close and open an electrical circuit, depending on the position of the central magnet, which is magnetically coupled with the coaxial annular magnet, the position of said annular magnet being determined by pressure of the fluid which enters the aforementioned chamber.

2. Electrical switch according to claim 1, characterized in that the annular magnet rests on a flexible diaphragm which is immobilized along its edges and defines a space of variable size, inside which the fluid enters. Pressure of said fluid is applied to one side of flexible diaphragm, which is also subjected to the thrust of a return spring which pushes it back toward its rest position, i.e., the position it occupies at minimum fluid pressure.

3. Electrical switch according to claim 2, characterized in that the flexible diaphragm is immobilized along its edges between the aforementioned body and an insulating casing which features an inner cylindrical wall surrounded by annular magnet, which houses and guides the central magnet. The insulating casing bears the electrical terminals which cooperate with the mobile contact piece (e.g., contact tongue moved by the central magnet.

4. Electrical switch according to claim 1, characterized in that the corresponding end faces of the central magnet and the annular magnet, i.e., the faces which present the same orientation, are of identical polarity (N or S), so that when annular magnet moves in either direction under the influence of the fluid pressure, the central magnet, and therefore, the mobile contact piece (e.g., contact tongue), move in the opposite direction.

5. Electrical switch according to claim 1, characterized in that the fluid passage of its body features, between inlet and outlet, a venturi with a neck which communicates (at point with the chamber housing the moving and/or flexible part linked to annular magnet.

6. Electrical switch according to claim 1, characterized in that it is used in a machine of the carpet shampooer type, as a safety switch protecting a pump which pressurizes a water-detergent mix drawn from a reservoir.

7. A method of operating an electrical switch in response to sensed changes in fluid pressure:

(a) forming a cavity having a relatively thin wall portion in a housing and disposing a switch in the cavity;

(b) disposing a first permanent magnet in said cavity adjacent said wall portion and connecting said magnet to a moveable member of said switch;

(c) forming a pressure chamber in the housing having said thin wall portion forming a part thereof and disposing a pressure responsive moveable member in said chamber;

(d) disposing a second permanent magnet for movement with said pressure responsive member and positioning said annular magnet adjacent said thin wall portion on the side thereof opposite said first magnet;

(e) forming a fluid passage in said housing having an inlet, outlet and forming a venturi throat in said passage between the inlet and outlet;

(f) tapping said venturi and connecting the tap to said pressure chamber; and, (g) flowing fluid through the venturi throat and moving said pressure responsive member and second magnet and magnetically effecting movement of said first magnet through said wall portion in response to the pressure in said venturi tap.

8. The method defined in claim 7 wherein said step of magnetically effecting movement includes magnetic repulsing said first magnet from said second magnet.

* * * * *